US006375067B1

(12) United States Patent
Moriyama

(10) Patent No.: US 6,375,067 B1
(45) Date of Patent: Apr. 23, 2002

(54) PACKAGING CONTAINER

(75) Inventor: Yasuyuki Moriyama, Funabashi (JP)

(73) Assignee: Tetra Laval Holdings & Finance, S.A. (CH)

( * ) Notice: Subject to any disclaimer, the term of this patent is extended or adjusted under 35 U.S.C. 154(b) by 0 days.

(21) Appl. No.: 09/744,474

(22) PCT Filed: Aug. 5, 1999

(86) PCT No.: PCT/JP99/04227

§ 371 Date: Jan. 25, 2001

§ 102(e) Date: Jan. 25, 2001

(87) PCT Pub. No.: WO00/07891

PCT Pub. Date: Feb. 17, 2000

(30) Foreign Application Priority Data

Aug. 5, 1998 (JP) ..... 10-221279

(51) Int. Cl.[7] ..... B65D 5/74

(52) U.S. Cl. ..... 229/125.09; 220/359.2; 229/123.2

(58) Field of Search ..... 229/123.2, 123.3, 229/125.09, 125.14, 125.15, 125.17; 220/270, 359.2, 359.3

(56) References Cited

U.S. PATENT DOCUMENTS 4,189,060 A * 2/1980 Trotman, III ..... 220/359.2
4,595,116 A * 6/1986 Carlsson ..... 220/359.3
4,770,325 A * 9/1988 Gordon et al. ..... 229/125.09
4,815,655 A * 3/1989 Jacobsson et al. ..... 229/123.2
4,819,839 A * 4/1989 Carlsson et al. ..... 229/125.15
4,944,408 A * 7/1990 Rausing ..... 220/270
5,125,529 A * 6/1992 Torterotot ..... 229/123.2
5,452,849 A * 9/1995 Schramer et al. ..... 220/125.09
5,653,383 A * 8/1997 Adachi et al. ..... 220/359.2
5,670,002 A * 9/1997 Stahlecker et al. .... 229/125.14
5,908,246 A * 6/1999 Arimura et al. ..... 229/123.2
6,106,757 A * 8/2000 Ohlsson et al. ..... 220/270
6,129,268 A * 10/2000 Stahlecker ..... 229/125.15

FOREIGN PATENT DOCUMENTS

JP 89704/1988 * 7/1988

* cited by examiner

*Primary Examiner*—Gary E. Elkins
(74) *Attorney, Agent, or Firm*—Lorusso & Loud

(57) ABSTRACT

The object is to provide a packaging container which can improve the quality of a packaging material (10) and which does not restrict the types of usable lid members (13). The packaging container has a container body (12) and a lid member (13) welded to the top wall **(12*a*) of the container body (12). The lid member (13) is composed of a main body portion (14) having an opening (21), as well as a lid portion (15) swingably supported by the main body portion (14). A rupturable portion (23) is formed in a discharge opening portion which is defined on the top wall (12*a*) at a predetermined position. The rupturable portion (23) is composed of a thin-wall portion (24) formed through reduction of the thickness of the packaging material (10) constituting the container body (12) and a rupture-line area formed through formation of a rupture line portion surrounding a predetermined area. When the lid member (13) is attached to the container body (12), the lower surface of the lid portion (15) is bonded to the predetermined area at at least a portion adjacent to the thin-wall portion (24). Since the lower surface of the lid portion (15) is bonded to the predetermined area at a portion adjacent to the thin-wall portion (24), when the lid portion (15) is pulled up and rotated, the rupturable portion (23)** is ruptured, so that the packaging container is opened.

3 Claims, 6 Drawing Sheets

PACKAGING CONTAINER

TECHNICAL FIELD

The present invention relates to a packaging container.

BACKGROUND ART

In a conventional packaging container for accommodating, for example, liquid food, a lid member made of a resin is welded to the top wall of a container body and is used to repeatedly open and close a discharge opening that is formed upon opening the packaging container.

For such a purpose, a rupturable portion is formed, through reduction of the thickness of a packaging material, in a discharge opening portion that is defined on the top wall at a predetermined position.

Accordingly, when a lid portion of the lid member is rotated, the rupturable portion is ruptured and thus the packaging container is opened.

FIG. 1 is a perspective view of a conventional container body; FIG. 2 is a cross-sectional view of a main portion of the conventional container body; FIG. 3 is a perspective view of a second conventional container body; and FIG. 4 is a cross-sectional view of a main portion of the second conventional container body.

In FIGS. 1 and 2, reference numeral 50 denotes a packaging material; 51 denotes a container body formed of the packaging material 50 and having the shape of, for example, an octagonal prism; 52 denotes a top wall of the container body 51; and 53 denotes a rupturable portion formed in a discharge opening portion which is defined on the top wall 52 at a predetermined position. The rupturable portion 53 is formed through reduction of the thickness of the packaging material 50.

Reference numeral 55 denotes a lid member made of a resin and welded to the top wall 52. The lid member 55 has a main body portion 56, and a lid portion 57, which is swingably supported by the main body portion 56 via an unillustrated hinge.

The packaging material 50 comprises an outer layer 61, a paper substrate 62, a bonding layer 63, a barrier layer 64, a bonding layer 65, and an inner layer 66, which are formed in this sequence from the outside to the inside of the packaging container. The outer layer 61, the bonding layers 63 and 65, and the inner layer 66 are typically formed of a resin such as polyethylene or an ethylene copolymer. The outer layer 61 and the inner layer 66 are preferably formed of low-density polyethylene. The barrier layer 64 is formed of aluminum foil or the like. If necessary, printing is performed on the outer surface of the outer layer 61 or the outer surface of the paper substrate 62. In a process for producing the packaging material 50, a hole 68 is punched in the paper substrate 62 at a portion corresponding to the rupturable portion 53. Therefore, the rupturable portion 53 is formed of the outer layer 61, the bonding layers 63 and 65, the barrier layer 64, and the inner layer 66, so that the rupturable portion 53 is thinner than the remaining portion by an amount corresponding to the thickness of the paper substrate 62.

Further, since the lower surface of the lid portion 57 is bonded to the rupturable portion 53, when the lid portion 57 is pulled up and rotated, the rupturable portion 53 is ruptured, so that the packaging container is opened. In place of the lid member 55, a pull-tab sheet may be used.

In FIGS. 3 and 4, reference numeral 50 denotes a packaging material; 51 denotes a container body; 52 denotes a top wall of the container body 51; and 73 denotes a rupturable portion. The rupturable portion 73 is formed through formation of perforations 76 surrounding a predetermined portion of the packaging material 50.

Reference numeral 75 denotes a lid member made of a resin and welded to the top wall 52. The lid member 75 has a main body portion 56, and an opening flap 77, which is swingably supported by the main body portion 56 via an unillustrated hinge.

The packaging material 50 comprises an outer layer 61, a paper substrate 62, a bonding layer 63, a barrier layer 64, a bonding layer 65, and an inner layer 66, which are formed in this sequence from the outside to the inside of the packaging container. In a process for producing the packaging material 50, perforations 76 are formed in the paper substrate 62 at a portion corresponding to the rupturable portion 73.

In this case, when the opening flap 77 is rotated about the hinge, the rupturable portion 73 is pulled up from the container body 51. As a result, the rupturable portion 73 is ruptured, and the packaging container is opened.

However, in the conventional packaging container having the rupturable portion 53 formed by thinning the packaging material 50, the outer layer 61 and the bonding layer 63 are difficult to bond together over the entire rupturable portion 53, with the result that pinholes are apt to be generated in an increased area at a bent portion of the outer layer 61; i.e., at the circumferential edge of the punched hole 68.

When the area where pinholes are apt to be generated increases, air becomes likely to enter the interior of the container body 51 via the pinholes, resulting in deterioration in the quality of the packaging material 50.

In the conventional packaging container having the rupturable portion 73 formed through formation of the perforations 76 surrounding a predetermined portion of the packaging material 50, since the strength of the rupturable portion 73 is high, the packaging container cannot be opened unless the rupturable portion 73 is pulled up from the container body 51.

Accordingly, the types of usable lid members are limited.

In view of the foregoing problems involved in the above-mentioned conventional packaging containers, an object of the present invention is to provide a packaging container which can improve the quality of a packaging material and which does not restrict the types of usable lid members.

DISCLOSURE OF THE INVENTION

To achieve the above objects, a packaging container according to the present invention comprises a container body and a lid member welded to a top wall of the container body. The lid member is composed of a main body portion having an opening and a lid portion swingably supported by the main body portion.

A rupturable portion is formed in a discharge opening portion which is defined on. the top wall at a predetermined position. The rupturable portion is composed of a thin-wall portion and a rupture-line area. The thin-wall portion is formed through reduction of the thickness of the packaging material, which constitutes the container body. The rupture-line area is formed through formation of a rupture line portion surrounding a predetermined area. When the lid member is attached to the container body, the lower surface of the lid portion is bonded to the predetermined area at at least a portion adjacent to the thin-wall portion.

In this case, since the lower surface of the lid portion is bonded to the predetermined area at a portion adjacent to the thin-wall portion, when the lid portion is pulled up and rotated, the rupturable portion is ruptured, so that a discharge opening is formed in the discharge opening portion, and the packaging container is thus opened.

Since the area of the thin-wall portion can be decreased by an amount corresponding to the area of the rupture-line area, the area at the inner circumferential edge of the punched hole where pinholes are apt to be generated can be decreased.

Accordingly, the amount of air that enters the interior of the container body via pinholes can be decreased, resulting in an improvement in the quality of the packaging material.

Further, since the strength of the rupturable portion can be decreased by an amount corresponding to the area of the thin-wall portion, the types of usable lid members are not restricted.

In another packaging container according to the present invention, the rupture-line portion is formed of perforations.

In still another packaging container according to the present invention, the rupture-line portion is formed of a half-cut line portion.

BEST MODE FOR CARRYING OUT THE INVENTION

Embodiments of the present invention will now be described in more detail with reference to the accompanying drawings.

Figure 1:
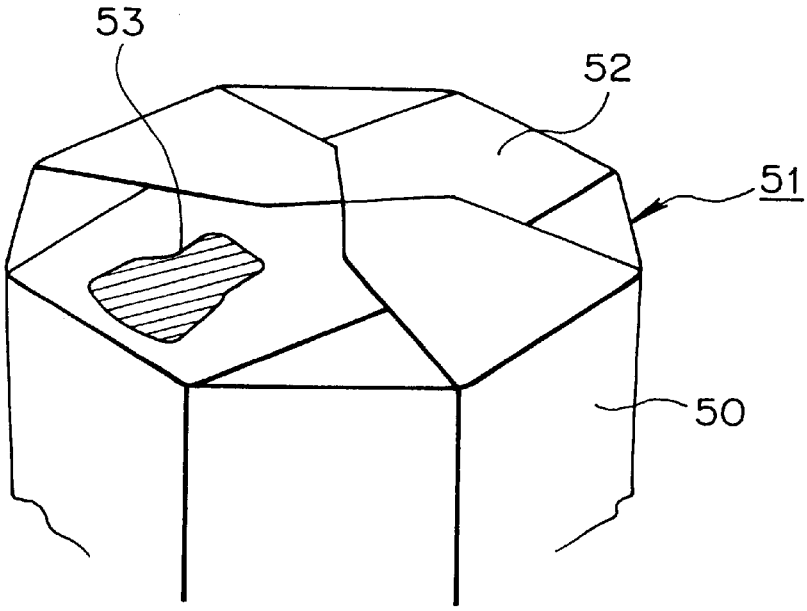
FIG. 1 is a perspective view of a conventional container body.
Figure 2:
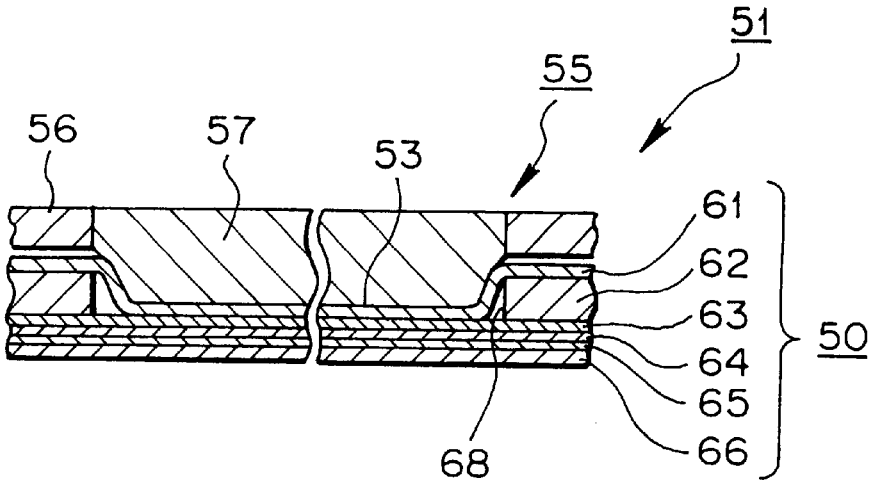
FIG. 2 is a cross-sectional view of a main portion of the conventional container body.
Figure 3:
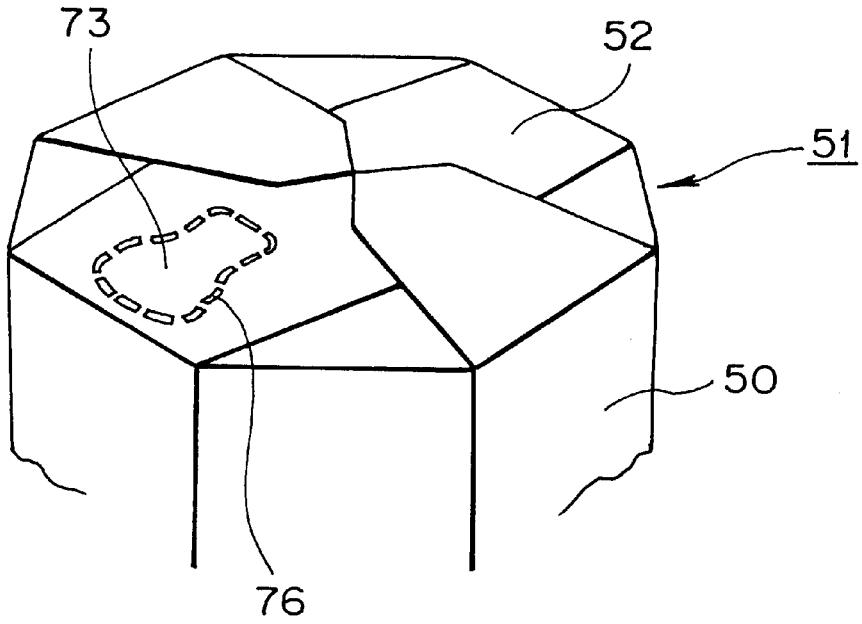
FIG. 3 is a perspective view of a second conventional container body.
Figure 4:
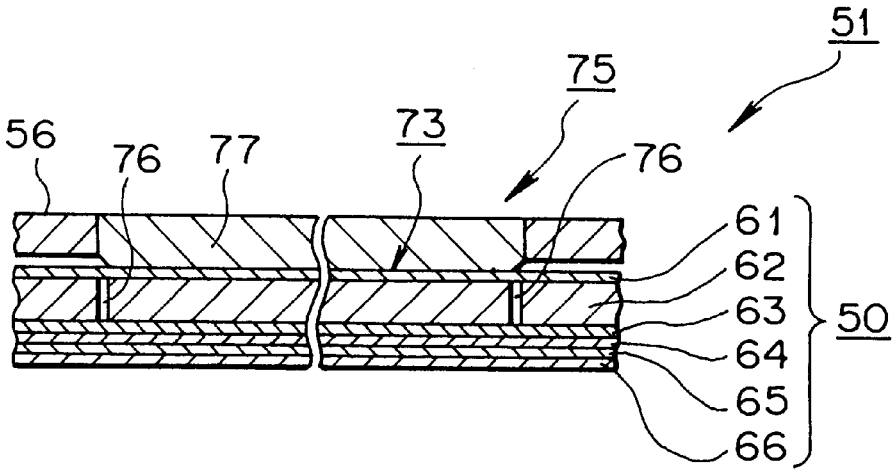
FIG. 4 is a cross-sectional view of a main portion of the second conventional container body.
Figure 5:
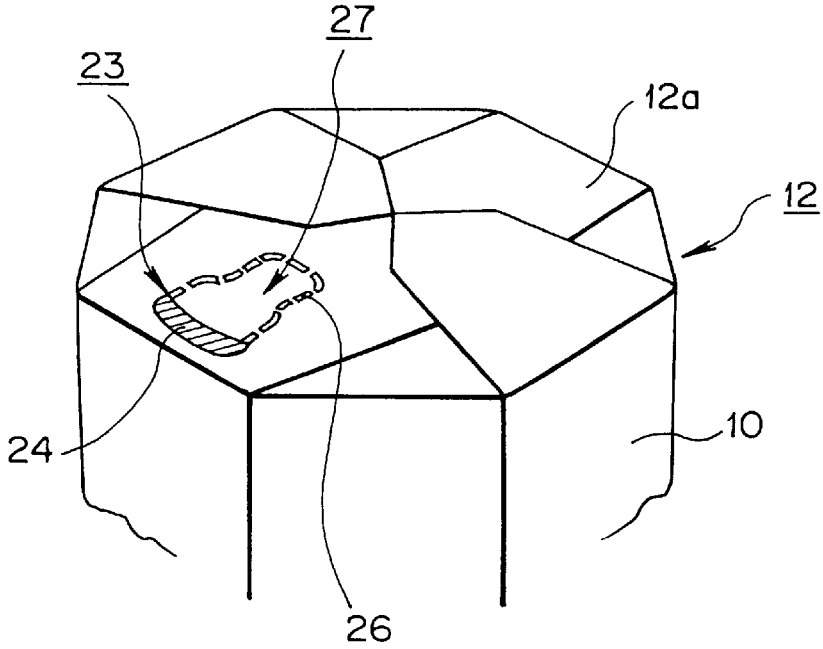
FIG. 5 is a perspective view of a container body according to a first embodiment of the present invention.
Figure 6:
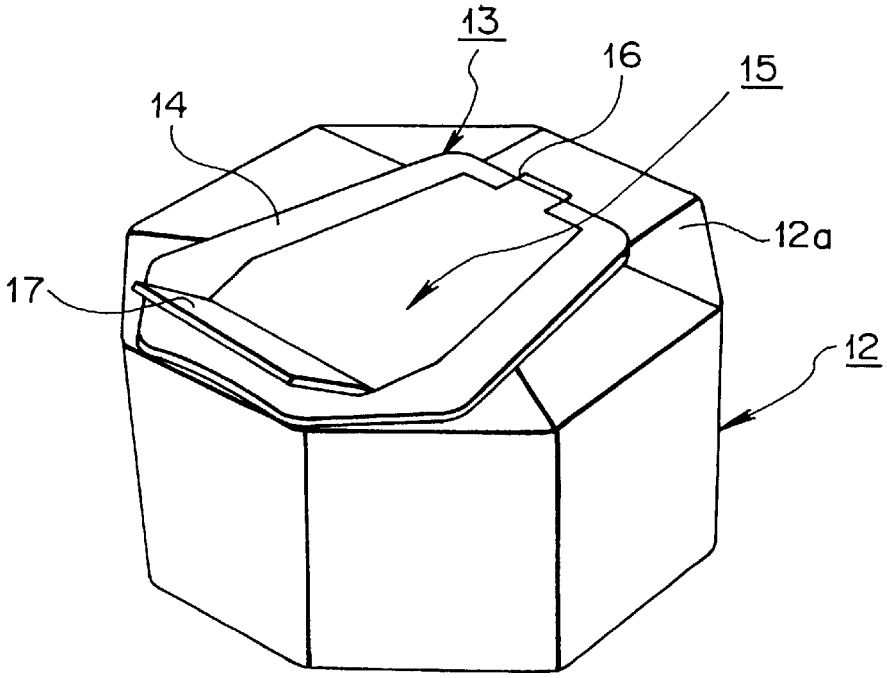
FIG. 6 is a perspective view showing a lid member used in the first embodiment of the present invention, when the lid member is in a closed state.
Figure 7:
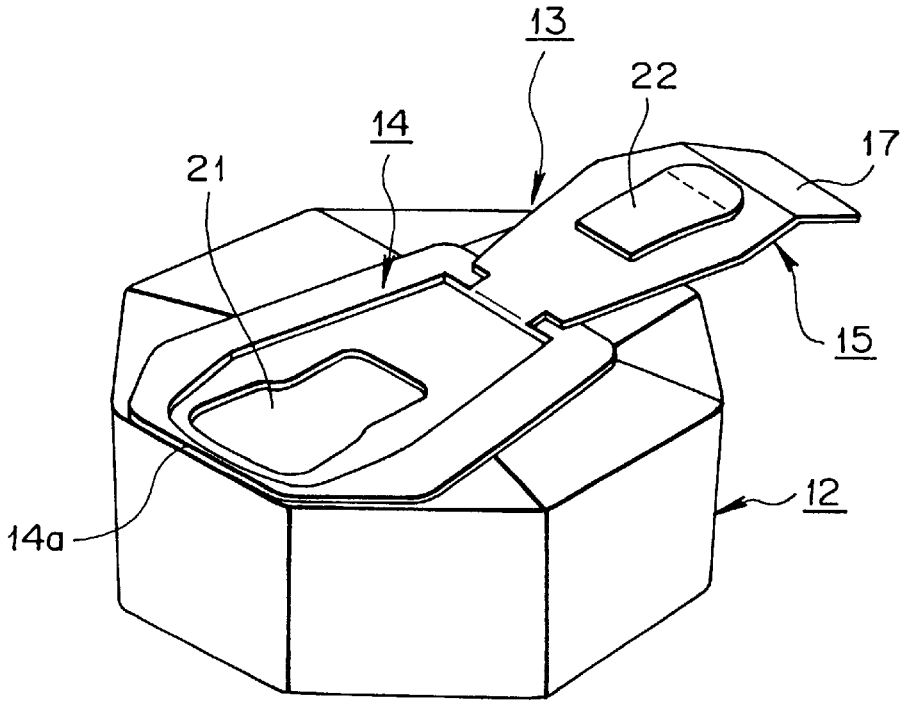
FIG. 7 is a perspective view showing the lid member used in the first embodiment of the present invention, when the lid member is in an open state.
Figure 8:
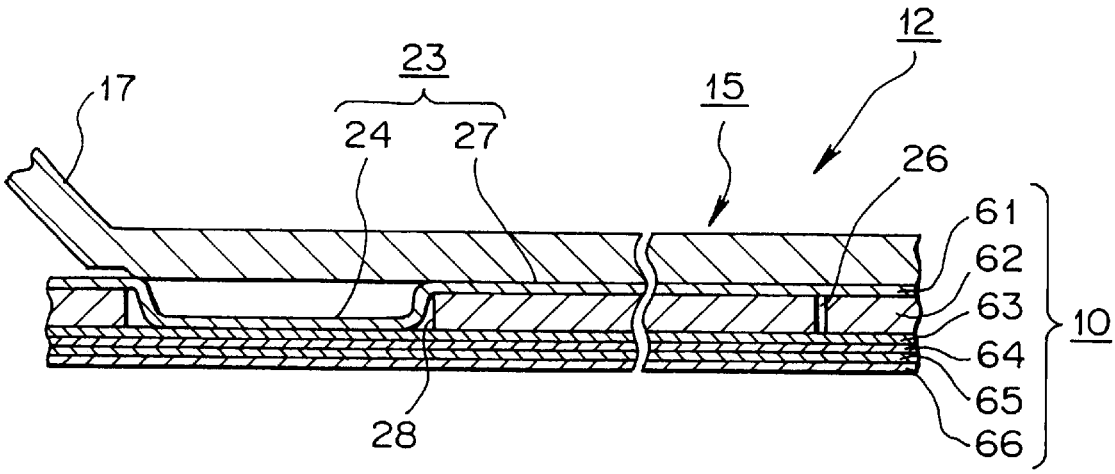
FIG. 8 is a cross-sectional view of a main portion of the container body according to the first embodiment of the present invention.

FIG. 5 is a perspective view of a container body according to a first embodiment of the present invention; FIG. 6 is a perspective view showing a lid member used in the first embodiment of the present invention, when the lid member is in a closed state; FIG. 7 is a perspective view showing the lid member used in the first embodiment of the present invention, when the lid member is in an open state; and FIG. 8 is a cross-sectional view of a main portion of the container body according to the first embodiment of the present invention.

In FIGS. 5–8, reference numeral 12 denotes a container body having the shape of, for example, an octagonal prism; and 13 denotes a lid member made of a resin and welded to the top wall 12*a* of the container body 12. The lid member 13 is composed of a main body portion 14 and a lid portion 15 swingably supported by the main body portion 14 via a hinge 16, and an opening 21 is formed in the main body portion 14 at a predetermined position. Further, a discharge opening portion is defined on the top wall 12*a* at a predetermined position, and the lid member 13 is positioned such that the discharge opening portion corresponds to the opening 21.

A handle 17 is formed at the tip end of the lid portion 15. A consumer can engage his/her finger with the handle 17 and rotate the lid portion 15 in order to place the lid portion 15 at an open position or a closed position.

A rupturable portion 23 is formed in the discharge opening portion such that the rupturable portion 23 has a shape corresponding to that of the opening 21. The rupturable portion 23 is composed of a slit-shaped thin-wall portion 24 and a perforated area 27 serving as a rupture-line area. The thin-wall portion 24 is formed by a method by which the thickness of a packaging material 10 that constitutes the container body 12 is reduced over a predetermined area. The perforated area 27 is an area surrounded by the thin-wall portion 24 and perforations 26 serving as a rupture line. When the lid member 13 is attached to the container body 12, the lower surface of the lid portion 15 is bonded to the perforated area 27 at at least a portion adjacent to the thin-wall portion 24.

The packaging material 10 comprises an outer layer 61, a paper substrate 62, a bonding layer 63, a barrier layer 64, a bonding layer 65, and an inner layer 66, which are formed in this sequence from the outside to the inside of the packaging container. The outer layer 61, the bonding layers 63 and 65, and the inner layer 66 are typically formed of a resin such as polyethylene or an ethylene copolymer. The outer layer 61 and the inner layer 66 are preferably formed of low-density polyethylene. The barrier layer 64 is formed of aluminum foil or the like. If necessary, printing is performed on the outer surface of the outer layer 61 or the outer surface of the paper substrate 62. In a process for producing the packaging material 10, a hole 28 is punched in the paper substrate 62 at a portion corresponding to the thin-wall portion 24. Therefore, the thin-wall portion 24 is formed of the outer layer 61, the bonding layers 63 and 65, the barrier layer 64, and the inner layer 66, so that the thin-wall portion 24 is thinner than the remaining portion by an amount corresponding to the thickness of the paper substrate 62.

Since the lower surface of the lid portion 15 is bonded or welded to the rupturable portion 23, when a consumer engages his/her finger with the handle 17 and pulls the lid portion 15 to rotate the same, the rupturable portion 23 is first ruptured easily. At this time, a portion of the perforations 26 adjacent to the thin-wall portion 24 have already ruptured. Therefore, the consumer can easily lift the area 27 with a small force to rupture the same. Consequently, a discharge opening is formed in the discharge opening portion, and the packaging container is thus opened. In FIG. 7, reference numeral 22 denotes a piece of the packaging material remaining on the lid portion 15 after the rupturable portion 23 has been ruptured.

Therefore, the consumer can drink an unillustrated liquid food from the packaging container, while placing his/her lips on a drinking portion 14*a* formed adjacent to the opening 21 of the main body portion 14.

In this case, since the area of the thin-wall portion 24 can be decreased by an amount corresponding to the area of the perforated area 27, the outer layer 61 and the bonding layer 63 can be easily bonded together over the entire thin-wall portion 24, and an area at the inner circumferential edge of the punched hole 28 where pinholes are apt to be generated can be decreased.

Accordingly, the amount of air that enters the interior of the container body 12 via pinholes can be decreased, resulting in improvement in the quality of the packaging material 10.

Further, since the strength of the rupturable portion 23 can be decreased by an amount corresponding to the area of the thin-wall portion 24, the types of usable lid members 13 are not restricted.

Next, a second embodiment of the present invention will be described. Portions having the same structures as those in the first embodiment are denoted by the same reference numbers, and repeated descriptions thereof are omitted.

Figure 9:
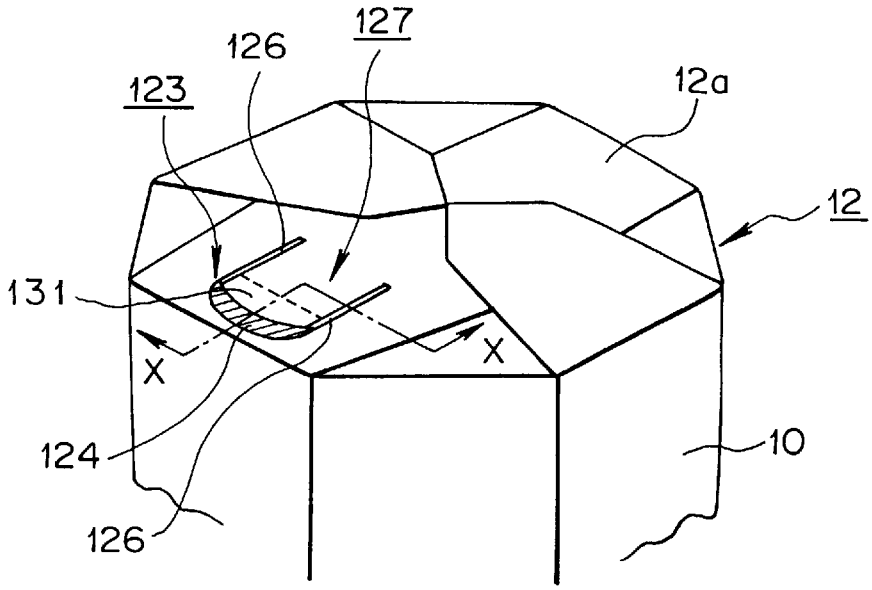
FIG. 9 is a perspective view of a container body according to the second embodiment of the present invention.
Figure 10:
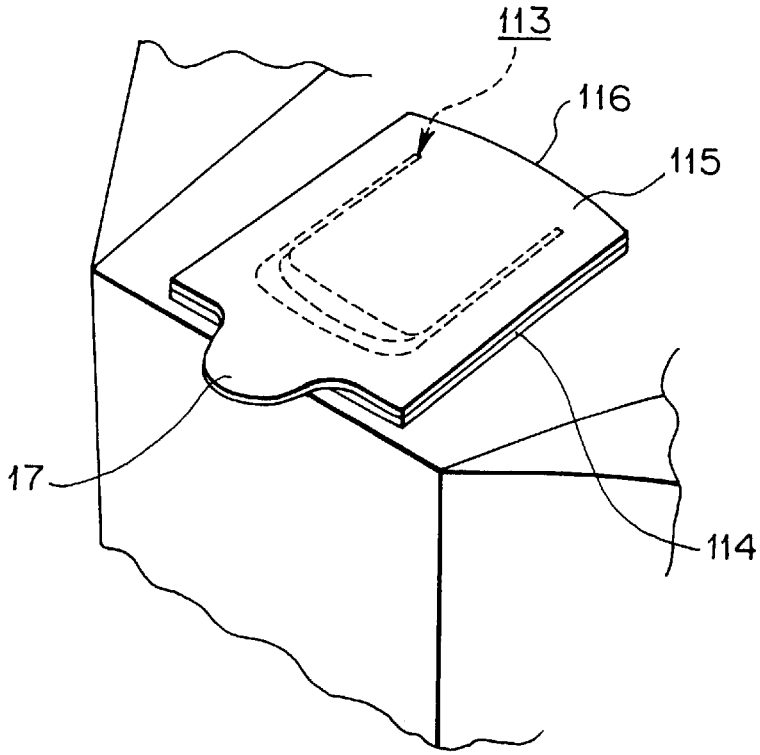
FIG. 10 is a perspective view showing a lid member used in the second embodiment of the present invention, when the lid member is in a closed state.
Figure 11:
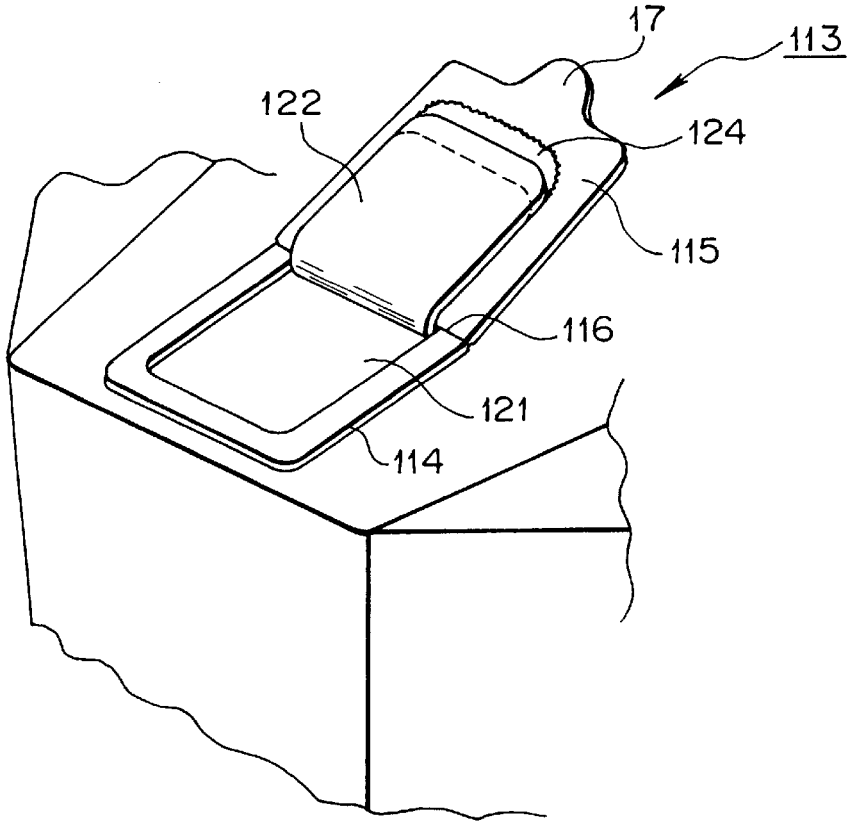
FIG. 11 is a perspective view showing the lid member used in the second embodiment of the present invention, when the lid member is in an open state.
Figure 12:
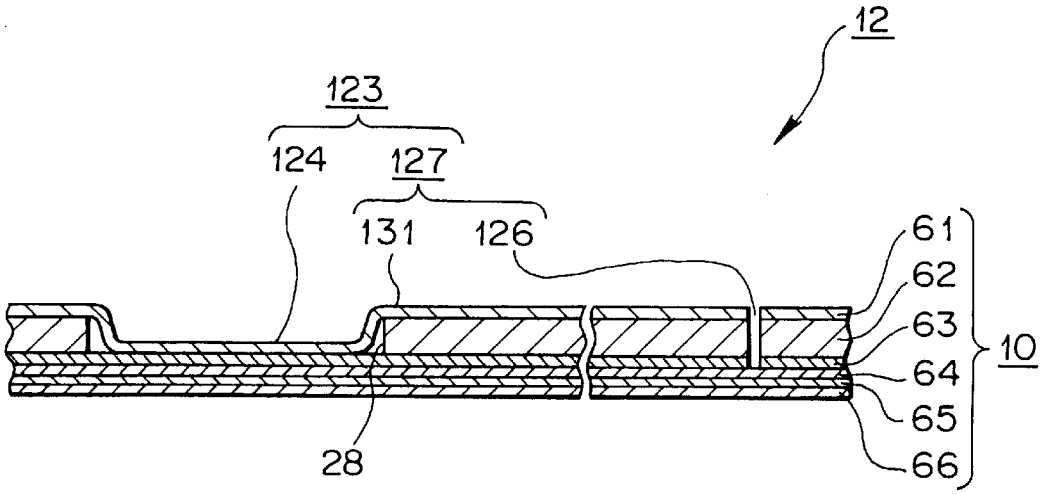
FIG. 12 is a cross-sectional view taken along line X—X in FIG. 9.

FIG. 9 is a perspective view of a container body according to the second embodiment of the present invention; FIG. 10 is a perspective view showing a lid member used in the second embodiment of the present invention, when the lid member is in a closed state; FIG. 11 is a perspective view showing the lid member used in the second embodiment of the present invention, when the lid member is in an open state; and FIG. 12 is a cross-sectional view taken along line X—X in FIG. 9.

In FIGS. 9–12, reference numeral 113 denotes a lid member made of a resin and welded to the top wall 12*a* of a container body 12. The lid member 113 is composed of a main body portion 114 and a lid portion 115 swingably supported by the main body portion 114 via a hinge 116, and an opening 121 is formed in the main body portion 114 at a predetermined position. Further, a discharge opening portion is defined on the top wall 12*a* at a predetermined position, and the lid member 113 is positioned such that the discharge opening portion corresponds to the opening 121.

A rupturable portion 123 having a "U"-like shape is formed in a discharge opening portion to correspond to the opening 121. The rupturable portion 123 is composed of a slit-shaped thin-wall portion 124 and a half-cut area 127 serving as the rupture-line area. The thin-wall portion 124 is formed by a method by which the thickness of a packaging material 10 that constitutes the container body 12 is reduced over a predetermined area. The half-cut area 127 is an area surrounded by the thin-wall portion 124 and half-cuts 126 serving as the rupture line portion. The half-cuts 126 are formed such that the half-cuts 126 extend from the opposite ends of the thin-wall portion 124 in a direction perpendicular to the thin-wall portion 124. Further, a bonding portion 131 is defined in the half-cut area 127 to cover at least a portion adjacent to the thin-wall portion 124. When the lid member 113 is attached to the container body 12, the lower surface of the lid portion 115 is bonded to the bonding portion 131.

The packaging material 10 comprises an outer layer 61, a paper substrate 62, a bonding layer 63, a barrier layer 64, a bonding layer 65, and an inner layer 66, which are formed in this sequence from the outside to the inside of the packaging container. The outer layer 61, the bonding layers 63 and 65, and the inner layer 66 are typically formed of a resin such as polyethylene or an ethylene copolymer. The outer layer 61 and the inner layer 66 are preferably formed of low-density polyethylene. The barrier layer 64 is formed of aluminum foil or the like. If necessary, printing is performed on the outer surface of the outer layer 61 or the outer surface of the paper substrate 62. In a process for producing the packaging material 10, a hole 28 is punched in the paper substrate 62 at a portion corresponding to the thin-wall portion 124. Therefore, the thin-wall portion 124 is formed of the outer layer 61, the bonding layers 63 and 65, the barrier layer 64, and the inner layer 66, so that the thin-wall portion 124 is thinner than the remaining portion of the container by an amount corresponding to the thickness of the paper substrate 62.

Further, during the process for producing the packaging material 10 or at a predetermined timing after the production process, the packaging material 10 is cut to a predetermined depth from the side of the outer layer 61 in order to form the half-cuts 126. In the present embodiment, the half-cuts 126 are formed such that only the barrier layer 64, the bonding layer 65, and the inner layer 66 remain at the half-cuts 126. Therefore, the thickness of the packaging material 10 decreases by an amount corresponding to the total thickness of the outer layer 61, the paper substrate 62, and the bonding layer 63.

Since the lower surface of the lid portion 115 is bonded or welded to the bonding portion 131, when a consumer engages his/her finger with the handle 17 and pulls the lid portion 115 to rotates the same, the rupturable portion 123 is first ruptured easily. At this time, a portion of the half-cuts 126 adjacent to the thin-wall portion 124 have already ruptured. Therefore, the consumer can easily lift the half-cut area 127 with a small force to rupture the same. Consequently, a discharge opening is formed in the discharge opening portion, and the packaging container is thus opened. In FIG. 11, reference numeral 122 denotes a piece of the packaging material remaining on the lid portion 115 after the rupturable portion 123 has been ruptured.

In this case, since the area of the thin-wall portion 124 can be decreased by an amount corresponding to the area of the half-cut area 127, the outer layer 61 and the bonding layer 63 can be easily bonded together over the entire thin-wall portion 124, and an area at the inner circumferential edge of the punched hole 28 where pinholes are apt to be generated can be decreased.

Accordingly, the amount of air that enters the interior of the container body 12 via pinholes can be decreased, resulting in improvement in the quality of the packaging material 10.

Further, since the strength of the rupturable portion 123 can be decreased by an amount corresponding to the area of the thin-wall portion 124, the types of usable lid members 113 are not restricted.

The present invention is not limited to the above-described embodiments. Numerous modifications and variations of the present invention are possible in light of the spirit of the present invention, and they are not excluded from the scope of the present invention.

Industrial Application

The present invention is applicable to packaging containers for accommodating liquid foods.

What is claimed is:

1. A packaging container comprising:

(a) a container body; and (b) a lid member welded to a top wall of said container body and composed of a main body portion and a lid portion swingably supported by said main body portion, said main body portion having an opening, wherein (c) a rupturable portion is formed in a discharge opening portion which is defined on said top wall at a predetermined position; and (d) said rupturable portion is composed of a thin-wall portion formed through reduction of the thickness of a packaging material constituting said container body and a rupture-line area formed through formation of a rupture line portion surrounding a predetermined area, the lower surface of said lid portion being bonded to said predetermined area at at least a portion adjacent to said thin-wall portion, when said lid member is attached to said container body.

2. A packaging container according to claim 1, wherein said rupture-line portion is formed of perforations.

3. A packaging container according to claim 1, wherein said rupture-line portion is formed of a half-cut line portion.

* * * * *